US009217267B2

(12) United States Patent
Duffy et al.

(10) Patent No.: US 9,217,267 B2
(45) Date of Patent: Dec. 22, 2015

(54) ADJUSTABLE PIVOT DECK LID

(71) Applicant: Techform Products Limited, Penetanguishene (CA)

(72) Inventors: Michael J. Duffy, Midland (CA); John R. Beckwith, Shelby Township, MI (US); David J. Smallwood, Barrie (CA)

(73) Assignee: Techform Products Limited, Penetanguishene (CA)

( * ) Notice: Subject to any disclaimer, the term of this patent is extended or adjusted under 35 U.S.C. 154(b) by 0 days.

(21) Appl. No.: 14/293,664

(22) Filed: Jun. 2, 2014

(65) Prior Publication Data

US 2014/0259528 A1 Sep. 18, 2014

Related U.S. Application Data

(63) Continuation of application No. 13/695,938, filed as application No. PCT/US2011/034920 on May 3, 2011, now abandoned.

(60) Provisional application No. 61/330,663, filed on May 3, 2010.

(51) Int. Cl.

| | |
|---|---|
| ***E05D 5/00*** | (2006.01) |
| ***E05D 7/04*** | (2006.01) |
| ***E05D 7/00*** | (2006.01) |
| ***E05D 3/02*** | (2006.01) |
| ***E05D 5/14*** | (2006.01) |
| ***E05D 5/16*** | (2006.01) |
| *E05D 5/06* | (2006.01) |

(52) U.S. Cl.

CPC ..... *E05D 7/0045* (2013.01); *E05D 3/02* (2013.01); *E05D 5/14* (2013.01); *E05D 5/16* (2013.01); *E05D 7/04* (2013.01); *E05D 5/062* (2013.01); *E05Y 2900/548* (2013.01); *Y10T 16/52* (2015.01); *Y10T 16/5323* (2015.01); *Y10T 29/24* (2015.01); *Y10T 29/49861* (2015.01); *Y10T 29/49863* (2015.01)

(58) Field of Classification Search

CPC ..... E05Y 2900/548; E05D 5/062; E05D 2005/067

USPC ..... 16/235, 237, 239, 246, 249, 386; 411/546; 296/76

See application file for complete search history.

(56) References Cited

U.S. PATENT DOCUMENTS

| | | | | |
|---|---|---|---|---|
| 3,421,177 | A * | 1/1969 | Broghammer | 16/263 |
| 3,554,588 | A * | 1/1971 | Reinsma et al. | 403/154 |
| 3,890,672 | A * | 6/1975 | Berthagen | 16/340 |
| 4,078,276 | A * | 3/1978 | Nunes | 16/271 |
| 4,353,146 | A * | 10/1982 | Brockhaus | 16/387 |
| 4,383,478 | A * | 5/1983 | Jones | 454/5 |

(Continued)

*Primary Examiner* — Victor Batson
*Assistant Examiner* — Jason W San
(74) *Attorney, Agent, or Firm* — Dickinson Wright PLLC

(57) ABSTRACT

An adjustable hinge set and a method for making it improves mounting of a deck lid to a motor vehicle body by permitting mass production adjustments without distortion or multiplication of the parts installed. A hinge set bracket with spaced flanges receiving a pivot strap and pivot therebetween is formed with a substantially vertical slot in each flange. At least one insert having a collar and a stem, reinforces the spacing between the support flanges, as the pivot pin compressionally engages the flanges. Preferably, two inserts having a collar and a stem have a combined length that reinforces the predetermined spacing within a predetermined tolerance when compression is adjusted.

23 Claims, 5 Drawing Sheets

(56) References Cited

U.S. PATENT DOCUMENTS

| | | | | | |
|---|---|---|---|---|---|
| 4,893,863 | A * | 1/1990 | Skonieczny et al. | 296/76 |
| 5,029,364 | A * | 7/1991 | Salazar | 16/382 |
| 5,029,930 | A * | 7/1991 | Ihrke et al. | 296/76 |
| 5,074,609 | A * | 12/1991 | Dear | 296/76 |
| 5,158,333 | A * | 10/1992 | Saville | 296/76 |
| 5,419,012 | A * | 5/1995 | Lewis | 16/306 |
| 5,584,099 | A * | 12/1996 | Westerdale | 16/245 |
| 5,873,619 | A * | 2/1999 | Lewkoski et al. | 296/76 |
| 5,890,556 | A * | 4/1999 | Shearn et al. | 180/69.21 |
| 5,906,029 | A * | 5/1999 | Fox | 16/386 |
| 5,967,586 | A * | 10/1999 | Duffy et al. | 296/76 |
| 6,273,632 | B1 * | 8/2001 | Takahashi et al. | 403/154 |
| 6,382,704 | B1 * | 5/2002 | Nastasoiu | 296/146.11 |
| 6,694,571 | B2 * | 2/2004 | Albright et al. | 16/386 |
| 7,096,536 | B2 * | 8/2006 | Johnson | 16/300 |
| 7,101,110 | B2 * | 9/2006 | LaPointe | 403/365 |
| 7,188,877 | B2 * | 3/2007 | Gonzalez et al. | 293/133 |
| 7,350,845 | B1 * | 4/2008 | Duffy | 296/76 |
| 7,594,301 | B2 * | 9/2009 | Krajenke et al. | 16/240 |
| 7,708,512 | B2 * | 5/2010 | McLean et al. | 411/533 |
| 8,046,918 | B2 * | 11/2011 | Yustick et al. | 29/897.2 |
| 8,307,514 | B2 * | 11/2012 | Clark, Sr. | 16/386 |
| 8,505,164 | B2 * | 8/2013 | Katou | 16/273 |
| 8,978,203 | B2 * | 3/2015 | Krajenke et al. | 16/86 R |
| 2003/0202856 | A1 | 10/2003 | Nilsen et al. | |
| 2005/0172453 | A1 * | 8/2005 | Duffy | 16/307 |
| 2008/0072399 | A1 * | 3/2008 | Krajenke et al. | 16/238 |
| 2008/0295290 | A1 * | 12/2008 | Murray et al. | 16/386 |
| 2010/0150644 | A1 * | 6/2010 | Yustick et al. | 403/19 |
| 2010/0251519 | A1 * | 10/2010 | Duffy | 16/304 |
| 2013/0020826 | A1 * | 1/2013 | Krajenke et al. | 296/76 |
| 2013/0111703 | A1 * | 5/2013 | Duffy et al. | 16/221 |

* cited by examiner

ADJUSTABLE PIVOT DECK LID

CROSS-REFERENCE TO RELATED APPLICATIONS

This application is a continuation of application Ser. No. 13/695,938, which is the National Stage of International Application No. PCT/US2011/034920, filed May 3, 2011, which claims the benefit of Provisional Application No. 61/330,663, filed May 3, 2010, which are incorporated herein by reference.

TECHNICAL FIELD

Field of the Invention

The present invention relates to hinges for pivotally mounting motor vehicle body deck lids to motor vehicle body structures for displacement to and between open and closed positions over an access opening to a compartment in the vehicle body structure, in which inserts reinforce the pivot strap bushings' contact with a mounting bracket holding a pivot pin in an elongated adjustment slot.

BACKGROUND OF THE INVENTION

Background Art

A common trunk lid hinge pivots a bent tube (strap) with respect to a vehicle body structure such as a body shelf panel. An end of the strap opposite the pivot is secured to a lid displaced as the strap swivels on a revolute joint. The joint may include a pivot opening, often formed by aligned openings through opposite walls of the tube. Two bushings are inserted into the aligned holes in the strap, and rotate on a pin, such as a bolt, carried inside a bracket that is attached to the shelf panel. The pivot pin acts as a beam that holds the strap and bushings in a fixed location for pivoting in the attachment bracket attached to the shelf.

When installing a deck lid such as a trunk lid in the assembly plant, proper alignments may best be accomplished with adjustments made in three dimensions to provide flushness between the three-dimensionally-contoured lid and the surrounding body panels. Accordingly, procedures include predefined fabrication tolerances for adjusting the positioning of the lid in one or more directions such as fore/aft, cross car and up/down. Fore/aft and cross car adjustments may be achieved by oversized holes on the hinge/body-mating surfaces. Because the orientation of these surfaces do not allow up/down adjustment, a separate mechanism should be included in the hinge configuration.

One previously known mechanism is an adjustable mechanism that slides the trunk lid pivot in a slot above and below its nominal position. However, such mechanisms may require numerous interacting parts that control displacement of the pivot that complicate fabrication and assembly, and increase expense of the hinge, and its installation under mass production processes. Such factors may be particularly undesirable for reducing the cost of supplying a vehicle production operation, and could preclude its incorporation in a product.

SUMMARY OF THE INVENTION

A configuration to reduce components and assembly difficulties may be a vertical slot in the bracket that allows the pivot pin in the form of a bolt to slide up and down during installation of the trunk lid, and then be held in place by a nut tightened to hold the pin rigidly in place. If a shoulder bolt and nut are used, the design may not be likely to withstand durability requirements because the bushings will be destroyed as they forcibly engage and may rotate against the slot trim edges in the bracket. Another drawback will be that the bolt-nut pair, when torqued to a torque adequate to hold position based on tensile requirements, will not provide enough friction due to the material omitted in the slot to hold the joint in place under automotive lid loads encountered under vehicle use conditions. This construction does not allow adequate surface-to-surface contact between the pivot structure and the shelf attachment bracket.

The invention includes embodiments that overcome the above disadvantages by installing axially dimensioned inserts with radially expanded collar as protection for the bushings as the hinge displacement forces induce rotating against the bracket's enlarged slot edges, as well as creating a rigid column resisting the large compressive loading that is induced when torquing a bolt-nut pair of a pivot pin to retain the placement of the pin in the bracket for flush lid mounting.

BRIEF DESCRIPTION OF THE DRAWINGS

The present invention will be better understood by reference to the following detailed description when read in conjunction with the accompanying drawing sheets, in which like reference characters refer to like parts throughout the views, and in which.

DETAILED DESCRIPTION OF THE PREFERRED EMBODIMENT(S)

Figure 1:
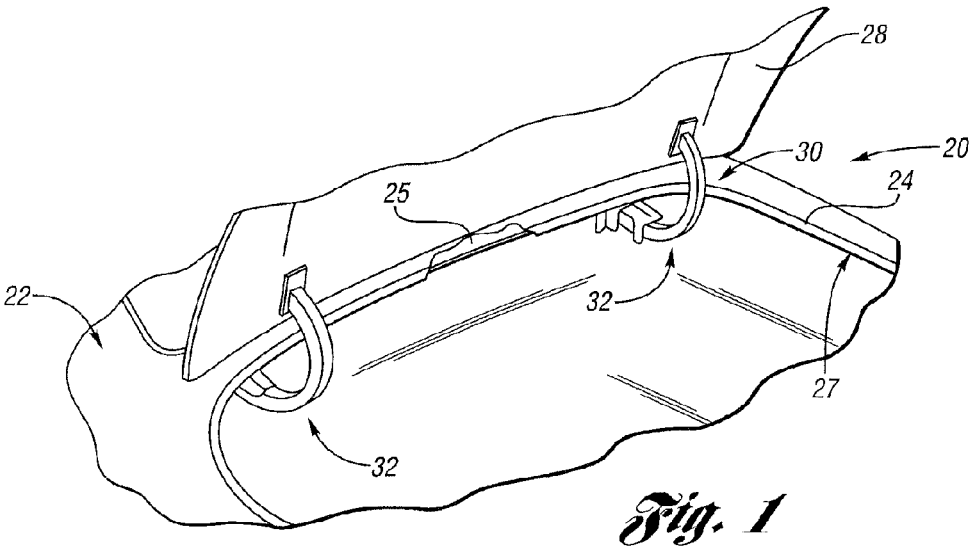
FIG. 1 is a perspective view of a trunk opening and a pair of hinge sets including an embodiment of the adjustable pivot for a deck or being installed in a motor vehicle body structure according to the present invention.

Referring first to FIG. 1, a hinged deck lid assembly 20 of a motor vehicle body 22 in which vehicle body structure 24 defines an opening 27 which is covered by a trunk lid 28. Displacement of the trunk lid 28 is controlled by a hinge 30 formed by a pair of hinge sets 32 (FIG. 2) that are spaced from each other across the vehicle body structure 24. Likewise, the strap 56 pivotally supported by each hinge set 32 is mounted to the lid at positions that are spaced across the vehicle body structure, shown in greater detail in FIG. 2.

Figure 2:
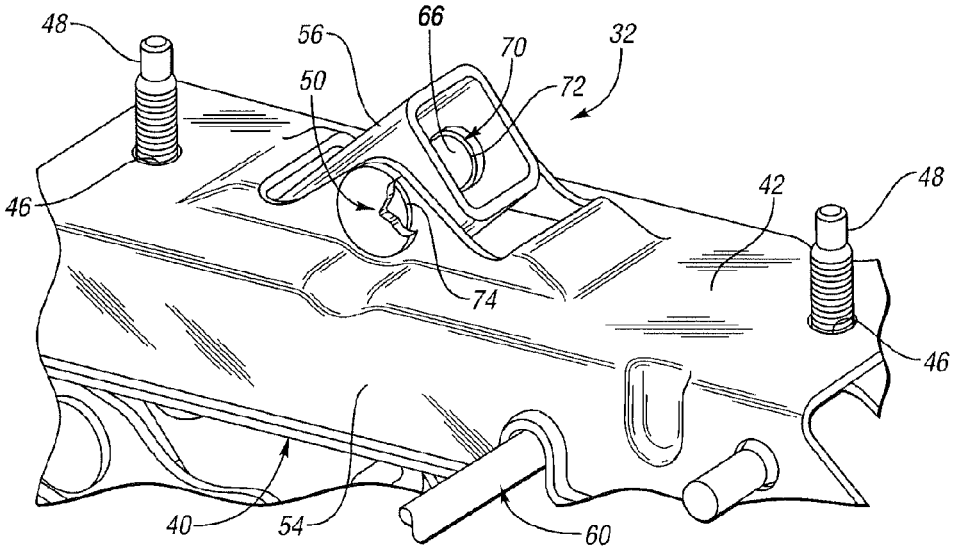
Fig. 2 (PRIOR ART)
FIG. 2 is an enlarged perspective view of a previously known hinge set structure that does not provide up/down adjustment of the deck lid with respect to the motor vehicle body structure with parts broken away for the sake of clarity.

As shown in FIG. 2, each hinge set 32 comprises a bracket 40 providing a mount 42 for securing the hinge set to the vehicle body structure 24. In the embodiment shown, the mount 42 comprises wall portions of a generally U-shaped channel member, the top wall of which includes openings 46 to receive fasteners such as bolts 48 for securing the bracket 40 to the vehicle body structure 24. For example, the bracket carries the pivot assembly 50 to a recessed or open area of the body structure 24 intermediate the openings 46. Bolts 48 secure the hinge set 32 to support structure 24, such as a shelf 25 of the vehicle body structure 24, with nuts or other threaded receivers in a known manner. Nevertheless, various configurations of the bracket and the mounting may be employed without departing from the present invention. In addition, the bracket 40 also includes body flanges 54 adapted to carry a biasing mechanism for spring biasing the pivoting of the strap that may be employed for assisting opening of the trunk lid from its closed to open position. An elongated torsion spring-type mechanism may be carried by the bracket, as shown at 60. However, numerous mechanisms for biasing the strap may be employed without departing from the present invention.

A previously known hinge construction as shown in FIG. 2 carries pivot support flanges 62 and 64 (FIG. 3) spaced from each other so as to receive the strap therebetween. In a previously known form, a rivet 66 extends through aligned openings in the walls of the tubular strap as well as openings in the pivot support flanges 62 and 64. The aligned openings in the strap 56 carry bushings 70 having an axially elongated stem 72 dimensioned to receive the body of a pivot pin for rotation about the axis of the pivot pin. A radially enlarged collar or flange 74 on the bushing 70 stabilizes the support between the wall of the strap 56 and the adjacent pivot support flanges 62, 64.

Figure 3A:
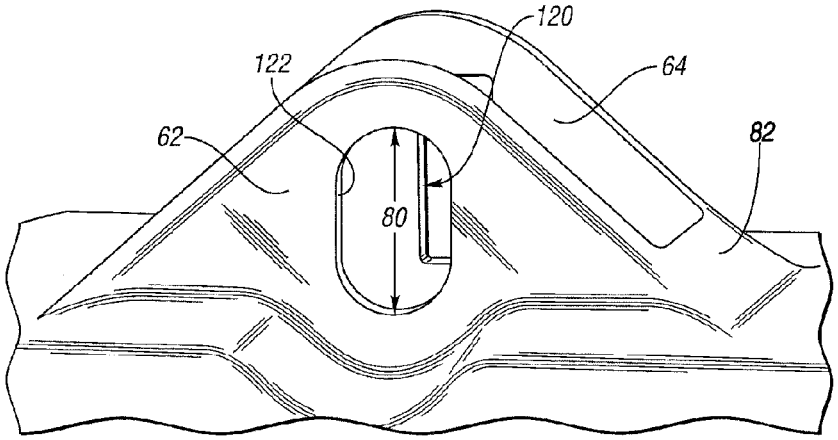
FIGS. 3A and 3B show a modification of the previously known hinge structure in FIG. 2 attempting to incorporate up/down adjustment of the vehicle hinge with an enlarged vertical slot without accommodating loads and forces induced in normal vehicle operating conditions at the pivot pin.

Referring now to FIG. 3A, potential to raise and lower the pivot axis for flush mounting the lid over the opening of the body structure is provided by elongating the opening in the pivot support flanges in direction 80 (FIG. 3). As shown, spacing between the flanges 62 and 64 may be reinforced in this view by the configured wall 82 preferably shows joining the spaced apart flanges 62 and 64. However, while such elongating the slots enables the pivot axis to be moved in an up/down direction to facilitate easier alignment to achieve flush lid mounting, the elongated slot provides a simpler realignment mechanism than the previously known production techniques of forcibly realigning portions of the hinge mounting components to reach a flush mounting of the lid at its closed position. Nevertheless, the expansive opening in the pivot support flanges substantially reduces the area of material used to guide the bushings carried by the strap, and reduces frictional engagement that may retain the pivot pin provided in the form of a nut and bolt at a fixed position. The elongated slots may have different shapes 120 and 122 as discussed below.

Figure 3B:
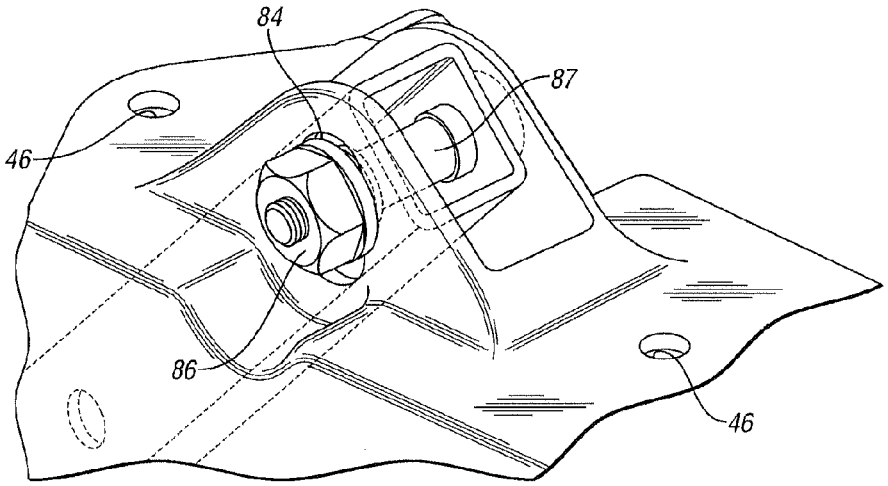

As shown in FIG. 3B, a radially expanded shoulder 84 on the nut 86, or on the head of the bolt, do not provide sufficient surface interaction between the collar 74 of the bushing and the pivot support flange 62, 64 to resist rotation when tightened to a predetermined torque determined to hold the pivot pin in a fixed position with respect to the elongated slot, and thereby subjecting the bushing to destructive interference with edges of the slotted flanges throughout the life of the hinge operation.

Figure 4:
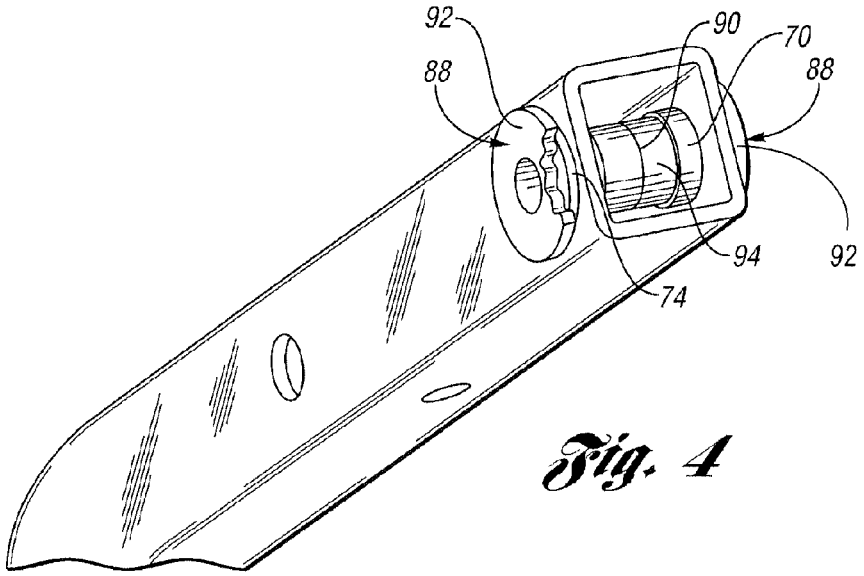
FIG. 4 is an enlarged perspective view of the strap incorporating collared inserts according to a preferred embodiment of the present invention with some structure removed for the sake of clarity.
Figure 5:
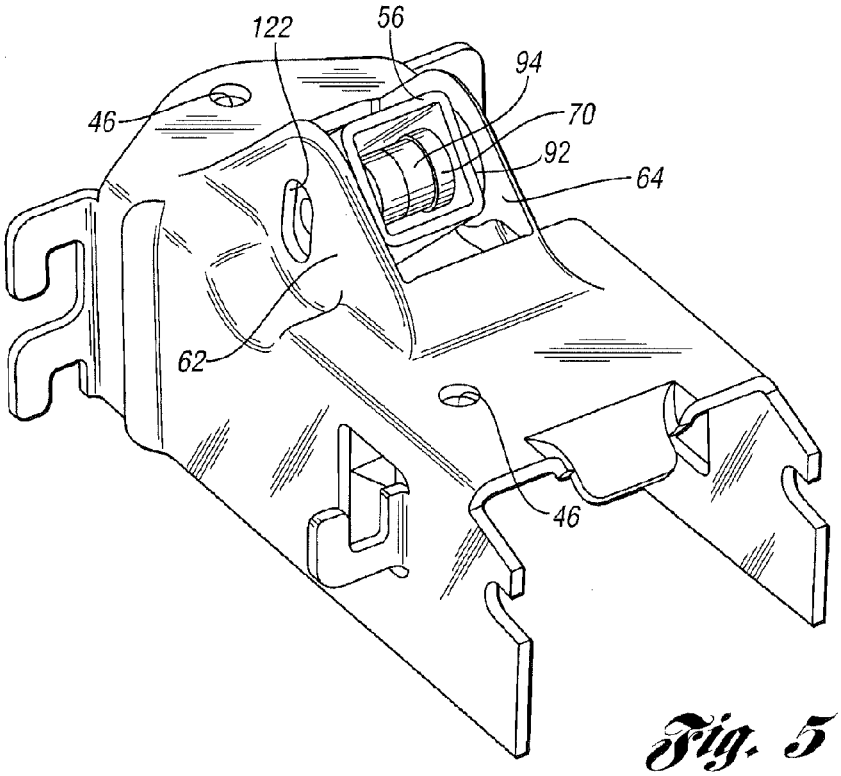
FIG. 5 is a perspective view of the members shown in FIG. 4 installed in a mounting bracket with some structure removed for the sake of clarity.

Distortions of the bushings, pivot support flanges and the like during tightening and operations of the hinge can be avoided by installation of an insert 87 (FIG. 3), with an embodiment including a pair of inserts 88, as shown in FIG. 4. The inserts 88 have expanded collars 92 as well as stems 94 which are preferably correspondingly dimensioned to work with the bushing, and wherein the pair of inserts 88 have stems 94 with a fixed axial dimension predefined with respect to the spacing between the pivot support flanges. Accordingly, the stems 94 include mating edges 90 so that an end-to-end arrangement of the aligned insert pair has a fixed dimension within a predetermined tolerance of the distance between pivot support walls. In addition, the flanges 74 of the bushings 70 have a first annular dimension and the collars 92 on the tubular inserts 88 have a second annular dimension at least as large as the first annular dimension. Thus, the radially expanded collars 92 cover at least as much, but preferably more, of the radial expanse of the collars flanges 74 on the bushings 70 when the inserts 88 are made separate from the bushings 70. As shown in FIG. 5, the enlarged collars 92 of the inserts 88 replace a reduced area of the pivot support flanges and are reinforced by the rigid column created with the end to end arrangement of the inserts 88.

In the illustrated embodiment of FIGS. 1 and 4-7, the inserts 88 include collars and stems dimensioned corresponding to the bushings 70 that are installed in the pivot pin opening in the strap. After the bushings 70 and the inserts 88 are installed, the strap 56 is positioned inside the shelf attachment bracket between the pivot support flanges having the enlarged slots. The collars 92 on the inserts 88 protect the bushings as they rotate with the strap 56 about the pin, protecting the edges of the slots, and also create a rigid column with an end to end arrangement of the stems that reinforce the box partition formed by the pivot mount flanges 62, 64 and the joining wall 82 of the bracket in place.

Figure 6:
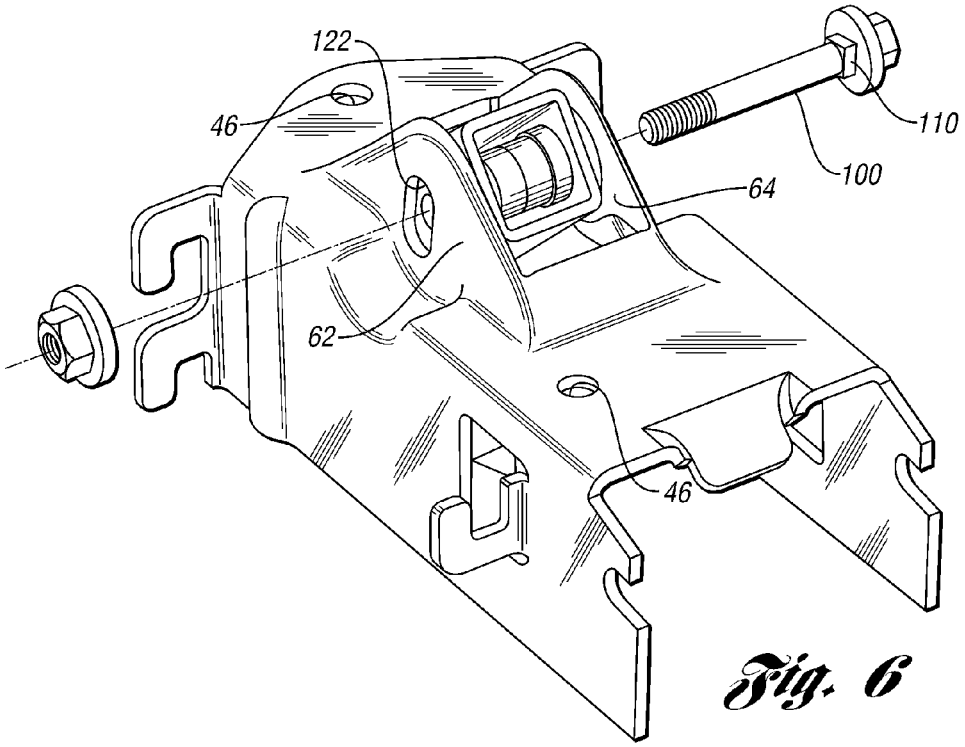
FIG. 6 is an exploded perspective view of a modified pivot pin embodiment incorporated in a preferred embodiment of the present invention with the structural features shown in FIG. 5.
Figure 7:
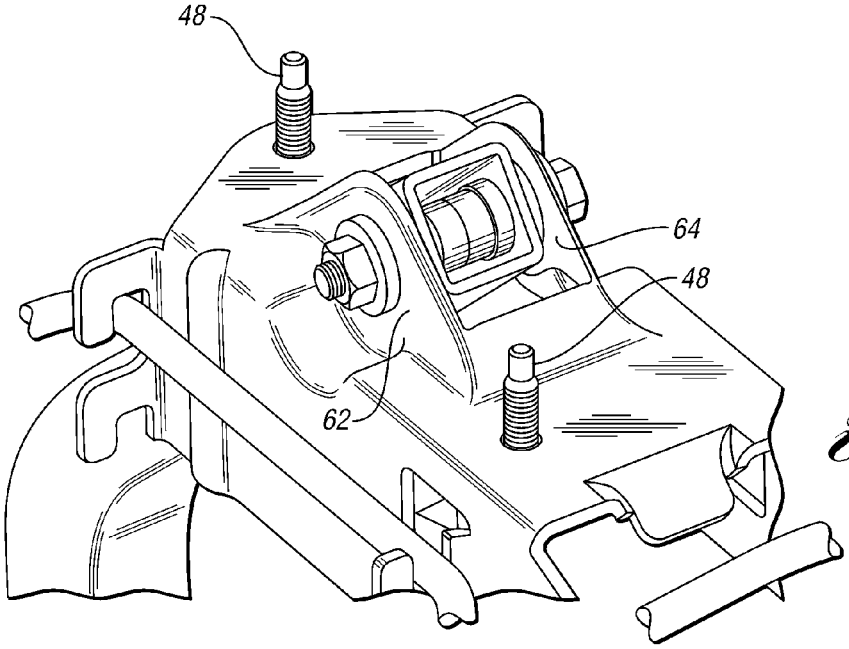
FIG. 7 is a perspective view of the assembled parts shown in FIGS. 4-6.
Figure 8:
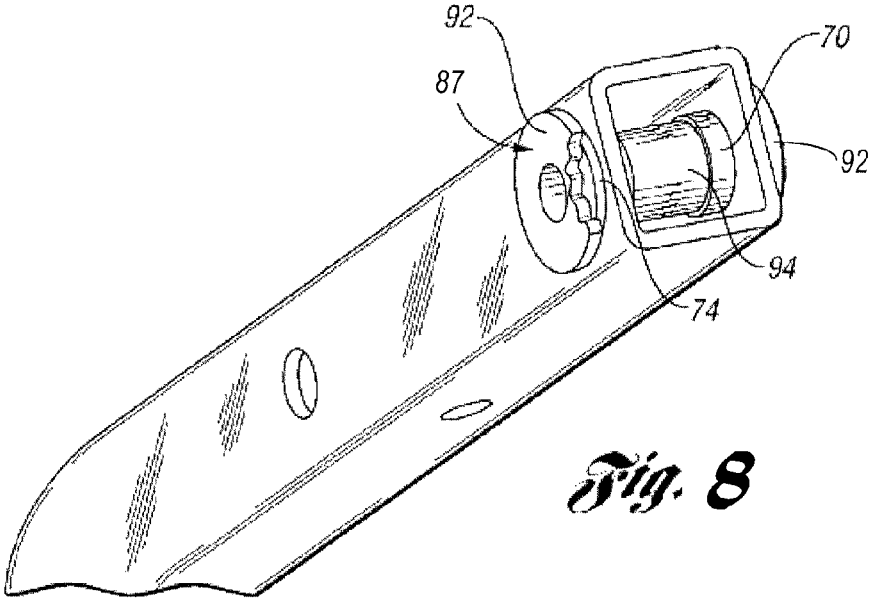
FIG. 8 is an enlarged perspective view of the strap incorporating a single tubular insert with a pair of collars according to another embodiment of the present invention, with some structure removed for the sake of clarity.

Although pivot pin parts shown in FIGS. 2 and 3 may be employed, a custom-configured bolt and nut may be torqued together to achieve a specified friction requirement is shown in FIG. 6. This torque induces large compressive loads on the collar inserts. The application of sufficient torque to maintain pivot pin position throughout operating conditions may be enhanced by flange or collar engaging resistors. In the illustrated embodiment, the bolt has an anti-rotation feature 100, while the nut is free to spin. In the preferred embodiment, the carriage bolt neck 100 is configured and dimensioned to match the slot in the flange so that the bolt resists rotation. This configuration may be reversed so that the nut does not rotate, depending on ergonomics and design requirements, without departing from the invention. Other surface-to-surface friction may be provided, for example, or other "grit" or friction coefficient-increasing surface treatments that engage to prevent slipping of the pivot inside the slot after the bolt and nut are torqued. The friction surfaces may be on the collars to the inside of the flanges on the shelf attachment bracket, the nut flange to the outside of the flange of the shelf attachment bracket, or the bolt flange to the outside of the flange of the shelf attachment bracket.

In a preferred method of production assembly, the pivot joint's bolt and nut can be loose during trunk lid installation so that the pivots self-align by positioning the lid flush with the body structure in the opening. After trunk lid flushness is achieved, the nut can be torqued to a specified torque to hold the pivot axis in place. The present invention improves upon previously known hinges by simplifying structure providing up/down adjustment of a pivot pin while reinforcing the assembly's durability under operating conditions and simplifying assembly procedures to obtain a flush fit of the deck lid over the body structure opening.

A motor vehicle hinge constructed in a preferred embodiment includes a hinge bracket having a mount and a pair of pivot support flanges spaced apart from each other, each pivot support flange having a generally vertical orientation when mounted, a substantially vertically elongated slot in each said pivot support flange, a tubular insert having a stem receivable through a pivot opening in a strap, and a collar covering a substantial portion of the slot, and the stems of the inserts having a combined length in an end-to-end alignment having a predetermined length within a predetermined tolerance of the space between the pivot support flanges. The pivot opening in the strap may be defined by a bushing. The bushing may have a stem and a collar. The collar of the bushing may have an enlarged annular dimension, and the insert collar may have an annular dimension at least as large as the bushing collar.

The present invention provides a method for facilitating up/down adjustment of a motor vehicle hinge assembly pivot with a simplified structure insert by enhancing strap bushing support and introducing rigid resistance to compressive load applied by a bolt/nut pair pivot pin.

A method embodiment may include improvement of deck lid assembly and alignment by elongating openings in a generally vertical direction in two spaced, pivot support flanges, covering substantial portions of a slot with an insert collar including a stem received at least partly through a pivot opening in a strap. The method may limit the stems to having an axial length in an end to end arrangement corresponding to the space between the pivot support flanges within a predetermined tolerance. The pivot opening in the strap may include bushings, where the stem of the insert extends through the bushing to engage the axial end of an opposed insert, and receives the pivot pin.

The pivot pin, or a locking nut, may be locked against rotation relative to the pivot support flanges by a resistor. A preferred, for example, formed as a square simple resistor is a neck below the bolt head shown in FIG. 6 configured to correspond with the geometry of the slot in the pivot support flanges. As shown in FIG. 3A, the elongated slot in the flange on one side is square-cornered on one side (at 120 in FIG. 3A) by the punch that forms it to provide an additional surface engagement at an end of the slot. Nevertheless, the slot on the other side (122 in FIG. 3A) still provides at least two surfaces for engagement with a neck 110. Nevertheless, a rounded-corner slot still provides two surfaces for resistance to turning, although the punch shape for forming the slot is variable without departing from the invention.

As required, details of an embodiment of the present invention are disclosed herein; however, it is to be understood that the disclosed embodiments are merely exemplary of the invention that may be embodied in various and alternative forms. Therefore, specific structural and functional details disclosed herein are not to be interpreted as limiting, but merely as a representative basis for teaching one skilled in the art to variously employ the present invention.

While exemplary embodiments are described above, it is not intended that these embodiments describe all possible forms of the invention. Rather, the words used in the specification are words of description rather than limitation, and it is understood that various changes may be made without departing from the spirit and scope of the invention as defined in the claims. Additionally, the features of various implementing embodiments may be combined to form further embodiments of the invention.

What is claimed is:

1. An adjustable hinge set for a motor vehicle deck lid, the hinge set comprising:

a pivot pin including a bolt and a nut, the bolt having a head end and a threaded end;

a hinge bracket having a pair of pivot support flanges spaced apart from each other, each pivot support flange having an elongated slot for receiving the pivot pin;

a strap having an end pivotally supported between the pair of pivot support flanges by the pivot pin, the end of the strap including a pair of bushings defining a pivot opening aligned with the elongated slots of the pivot support flanges, the pivot pin being received through the pivot opening in the end of the strap; and an insert assembly including a tubular insert and a pair of collars, the tubular insert receivable through the pivot opening in the strap and receiving the pivot pin therethrough, the tubular insert having a length corresponding to the space between the pivot support flanges, each collar located at an opposite end of the tubular insert and disposed between the strap and a respective pivot support flange, and each collar extending radially outward from the respective end of the tubular insert beyond the elongated slot to cover a portion of the pivot support flange;

wherein the insert assembly forms a rigid column extending from one of the pivot support flanges to the other pivot support flange, and the pivot pin, when inserted through the insert assembly and elongated slots and tightened against the pivot support flanges, introduces a compressive load on the insert assembly sufficient to maintain the pivot pin in a fixed position within the elongated slots while limiting the clamping force applied to the strap.

2. The adjustable hinge set of claim 1, wherein the tubular insert comprises a pair of inserts, each insert having a stem such that the combined end-to-end alignment of the pair of inserts has the length corresponding to the space between the pivot support flanges.

3. The adjustable hinge set of claim 2, wherein each collar is integral with a respective one of the pair of inserts.

4. The adjustable hinge set of claim 3, wherein each stem of the pair of inserts includes a mating edge at an axial end opposite the collar, the pair of inserts engaging each other at their respective mating edges to form the tubular insert for receiving the pivot pin.

5. The adjustable hinge set of claim 3, wherein each bushing has a stem and a flange extending radially outward from the stem, the flange of each bushing having a first annular dimension and each collar having a second annular dimension at least as large as the first annular dimension.

6. The adjustable hinge set of claim 1, wherein the pivot pin includes an anti-rotation feature that locks the pivot pin from rotation relative to the pivot support flanges.

7. The adjustable hinge set of claim 6, wherein the anti-rotation feature is a neck provided on the bolt for engaging with one of the elongated slots.

8. An adjustable hinge set for a motor vehicle deck lid, the hinge set comprising:

a hinge bracket having a pair of pivot support flanges spaced apart from each other, each pivot support flange having an elongated slot;

a pivot pin received in the elongated slot of the pivot support flanges;

a tubular strap having an end pivotally supported between the pair of pivot support flanges by the pivot pin, the end of the strap defining a pair of holes aligned with one another and with the elongated slots of the pivot support flanges, the pivot pin being received through the pair of aligned holes in the end of the strap;

a pair of bushings, each bushing inserted in a respective one of the aligned holes of the strap, and the bushings defining a pivot opening for receiving the pivot pin; and a pair of tubular inserts receivable through the pivot opening and receiving the pivot pin, each tubular insert having an axially-extending stem insertable through one of the pair of bushings and a radially-extending collar disposed at an end of the stem between the strap and a respective pivot support flange and covering a portion of the elongated slot, the stems of the tubular inserts having mating edges disposed at ends opposite the collars such that the combined end-to-end alignment of the pair of tubular inserts has a length extending continuously from one of the pivot support flanges to the other pivot support flange.

9. The adjustable hinge set of claim 8, wherein each bushing has a stem and a flange extending radially outward from the stem, the flange of each bushing having a first annular dimension and each collar having a second annular dimension at least as large as the first annular dimension.

10. The adjustable hinge set of claim 8, wherein the pivot pin includes a bolt and a nut torqued together to induce a compressive load on the tubular insert sufficient to maintain the pivot pin in a fixed position within the elongated slots.

11. The adjustable hinge set of claim 10, wherein the pivot pin includes an anti-rotation feature that locks the pivot pin from rotation relative to the pivot support flanges.

12. The adjustable hinge set of claim 11, wherein the anti-rotation feature is a neck provided on the bolt for engaging with one of the elongated slots.

13. A method for facilitating up/down adjustment of a motor vehicle hinge assembly pivot held by spaced-apart, pivot support flanges that have substantially vertical elongated slots, the method comprising:

positioning an end of a strap between the pivot support flanges, the end of the strap including a pair of holes aligned with one another and including a pair of bushings each inserted into a respective one of the aligned holes, the bushings defining a pivot opening;

the step of positioning the strap between the pivot support flanges including aligning the holes of the strap with the elongated slots of the pivot support flanges, installing a tubular insert into the pivot opening, the tubular insert having a stem with a length extending from one of the pivot support flanges to the other pivot support flange;

inserting a pivot pin through the elongated slots of the pivot support flanges and the stem of the tubular insert, the pivot pin formed from a bolt and a nut;

adjusting alignment of the pivot pin in the elongated slots; and tightening the bolt and nut.

14. The method of claim 13, wherein installing the structural tubular insert comprises installing a pair of inserts, each of the pair of inserts having a stem and a collar located at an end of the insert, each collar disposed between the strap and a respective pivot support flange and covering a portion of an elongated slot, the combined end-to-end alignment of the pair of inserts having the length corresponding to the space between the pivot support flanges.

15. The method of claim 14, wherein each stem of the pair of inserts includes a mating edge at an opposite end of the collar, the pair of inserts engaging each other at their respective mating edges to form the tubular insert for receiving the pivot pin.

16. The method of claim 13, further comprising locking the pivot pin against rotation relative to the pivot support flanges.

17. The method of claim 16, wherein the pivot pin includes an antirotation feature for engaging with at least one elongated slot to resist rotation relative to the pivot support flanges.

18. The adjustable hinge set of claim 1, wherein the pivot pin, when inserted through the insert assembly and elongated slots and tightened against the pivot support flanges, introduces a compressive load on the insert assembly sufficient to maintain the pivot pin in a fixed position within the elongated slots while limiting the clamping force applied to the strap.

19. The adjustable hinge set of claim 7, wherein the neck is received in the elongated slot and has a dimension matching a dimension of the elongated slot to resist rotation.

20. The method of claim 13, wherein the step of tightening the bolt and nut introduces rigid resistance to a compressive load applied by the bolt and nut to the tubular insert.

21. The adjustable hinge set of claim 1, wherein each collar is disposed axially between the strap and the respective pivot support flange, and the collars are disposed parallel to the pivot support flanges.

22. The adjustable hinge set of claim 8, wherein each collar is disposed axially between the strap and the respective pivot support flange, and the collars are disposed parallel to the pivot support flanges.

23. The method of claim 14, wherein each collar is disposed axially between the strap and the respective pivot support flange, and the collars are disposed parallel to the pivot support flanges.

* * * * *